US008474739B2

(12) United States Patent
Ruola

(10) Patent No.: US 8,474,739 B2
(45) Date of Patent: Jul. 2, 2013

(54) REFINING SURFACE FOR A REFINER

(75) Inventor: Ville Ruola, Toijala (FI)

(73) Assignee: Metso Paper, Inc., Helsinki (FI)

( * ) Notice: Subject to any disclaimer, the term of this patent is extended or adjusted under 35 U.S.C. 154(b) by 26 days.

(21) Appl. No.: 13/256,921

(22) PCT Filed: Mar. 12, 2010

(86) PCT No.: PCT/FI2010/050194
§ 371 (c)(1),
(2), (4) Date: Sep. 15, 2011

(87) PCT Pub. No.: WO2010/106225
PCT Pub. Date: Sep. 23, 2010

(65) Prior Publication Data

US 2012/0006924 A1 Jan. 12, 2012

(30) Foreign Application Priority Data

Mar. 18, 2009 (FI) ..... 20095283

(51) Int. Cl.
*B02C 13/30* (2006.01)

(52) U.S. Cl.
USPC ..... 241/261.3; 241/261.2; 241/298; 241/297; 241/296

(58) Field of Classification Search
USPC ..... 241/261.2, 261.3, 298, 297, 296
See application file for complete search history.

(56) References Cited

U.S. PATENT DOCUMENTS

| | | | | |
|---|---|---|---|---|
| 2005/0230511 | A1* | 10/2005 | Johansson et al. | 241/261.2 |
| 2006/0006264 | A1* | 1/2006 | Sabourin et al. | 241/261.2 |
| 2006/0151648 | A1* | 7/2006 | Vuorio et al. | 241/261.2 |
| 2007/0084952 | A1* | 4/2007 | Sjostrom et al. | 241/261.2 |
| 2007/0164143 | A1* | 7/2007 | Sabourin et al. | 241/261.2 |
| 2007/0210197 | A1* | 9/2007 | Carpenter | 241/298 |
| 2008/0078854 | A1* | 4/2008 | Sabourin et al. | 241/261.2 |
| 2008/0296419 | A1* | 12/2008 | Gingras | 241/28 |
| 2009/0145990 | A1* | 6/2009 | Vuorio | 241/261.3 |

FOREIGN PATENT DOCUMENTS

WO 2010/106225 A1 9/2010

OTHER PUBLICATIONS

International Search Report for PCT/FI2010/050194.
Written Opinion of the International Searching Authority for PCT/FI2010/050194.

* cited by examiner

*Primary Examiner* — Dana Ross
*Assistant Examiner* — Onekki Jolly
(74) *Attorney, Agent, or Firm* — Stiennon & Stiennon

(57) ABSTRACT

A refining surface (1, 2) of a refiner for defibrating lignocellulose-containing material has a first blade bar (14') and a second blade bar (14") with a blade groove (15) therebetween. A third blade bar has a rising guide surface (21) for guiding the lignocellulose-containing material to an upper surface (14*c*) of the third blade bar. The third bar guide surface is arranged, in the direction of travel of the first and the second blade bar (14"), at least partly between the first and the second blade bar, between the first blade bar and an imaginary extension of the second blade bar, between an imaginary extension of the first blade bar and the second blade bar, or between the imaginary extensions of both the first and the second blade bar.

21 Claims, 8 Drawing Sheets

REFINING SURFACE FOR A REFINER

CROSS REFERENCES TO RELATED APPLICATIONS

This application is a U.S. national stage application of International App. No. PCT/FI2010/050194, filed Mar. 12, 2010, the disclosure of which is incorporated by reference herein, and claims priority on Finnish App. No. 20095283, filed Mar. 18, 2009, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a refining surface of a refiner for a refiner intended for defibrating lignocellulose-containing material, which refining surface has a feed edge directed in the direction of the feed flow of the material to be refined and a discharge edge directed in the direction of the discharge flow of the refined material and which refining surface comprises at least one first blade bar and at least one second blade bar, between which there is a blade groove, the first and the second blade bars having a first end directed in the direction of the feed edge of the refining surface and a second end directed in the direction of the discharge edge of the refining surface; and that the refining surface comprises at least one third blade bar having a first end directed in the direction of the feed edge of the refining surface, and a second end directed in the direction of the discharge edge of the refining surface; and that the first end of the third blade bar has a guide surface rising from the direction of the feed edge of the refining surface in the direction of the discharge edge of the refining surface for guiding the lignocellulose-containing material to the upper surface of the third blade bar, the guide surface having a first end directed in the direction of the feed edge of the refining surface and a second end directed in the direction of the discharge edge of the refining surface.

Further, the invention relates to a blade segment of a refining surface for a refiner intended for defibrating lignocellulose-containing material, which blade segment is arrangeable to form a part of the refining surface of the refiner and which blade segment has a refining surface of the blade segment, the refining surface having a feed edge directed in the direction of the feed flow of the material to be refined and a discharge edge directed in the direction of the discharge flow of the refined material, and the refining surface of the blade segment comprising at least one first blade bar and at least one second blade bar, between which there is a blade groove, the first and the second blade bar having a first end directed in the direction of the feed edge of the refining surface and a second end directed in the direction of the discharge edge of the refining surface; and that the refining surface comprises at least one third blade bar having a first end directed in the direction of the feed edge of the refining surface and a second end directed in the direction of the discharge edge of the refining surface; and that the first end of the third blade bar has a guide surface rising from the direction of the feed edge of the refining surface in the direction of the discharge edge of the refining surface for guiding the lignocellulose-containing material to the upper surface of the third blade bar, the guide surface having a first end directed in the direction of the feed edge of the refining surface and a second end directed in the direction of the discharge edge of the refining surface.

Further, the invention relates to a refiner for defibrating lignocellulose-containing material.

Refiners used for manufacturing mechanical pulp typically comprise two or more refiner elements positioned oppositely and rotating relative to each other. The fixed, i.e. stationary, refiner element is called the stator of the refiner, the rotating or rotatable refiner element being called the rotor of the refiner. In disc refiners, the refiner elements are disc-like, and in cone refiners, the refiner elements are conical. In addition to disc refiners and cone refiners, there are also what are called disc-cone refiners, where disc-like refiner elements come first in the flow direction of the material to be defibrated, and after them the material to be defibrated is refined further between conical refiner elements. Furthermore, there are also cylindrical refiners, where both the stator and the rotor of the refiner are cylindrical refiner elements. The refining surfaces of the refiner elements are formed by blade bars, i.e. bars, and blade grooves, i.e. grooves, between them. The task of the blade bars is to defibrate the lignocellulosic material, and the task of the blade grooves is to transport both material to be defibrated and material already defibrated on the refining surface. In disc refiners, which represent the most common refiner type, the material to be refined is usually fed through an opening in the middle of the stator, i.e. on the inner periphery of the refining surface of the stator, to the space between the refining surfaces of the discs, i.e. to a blade gap. The refined material is discharged from the blade gap, from the outer periphery of the refining surfaces of the refiner discs, to be fed onwards in the pulp manufacturing process. The refining surfaces of the refiner discs may be either surfaces formed directly on the refiner discs, or they may be formed as separate blade segments positioned adjacent to each other in such a way that each blade segment forms a part of a continuous refining surface.

Usually, dams connecting two adjacent blade bars to each other are positioned at the bottom of the blade grooves of the refining surfaces of both the stator and the rotor of the refiner. The task of the dams is to guide material to be refined and material already refined to the space between the blade bars of opposite refining surfaces to be further refined. Since the dams guide the material to be refined to the space between opposite blade bars, refining the material can be promoted thanks to the dams. Simultaneously, however, the dams cause the steam flow taking the material to be refined onwards in the blade grooves to decrease, and prevent passage of the material to be refined and the material already refined on the refining surface by restricting the cross-sectional flow area of the blade grooves. This, in turn, leads to blockages on the refining surface, which then results in a decrease in the production capacity of the refiner, non-uniformity of the quality of the refined material and an increase in the energy consumed for the refining.

SUMMARY OF THE INVENTION

An object of this invention is to provide a refining surface of a novel type for a refiner.

The refining surface according to the invention is characterized in that said guide surface is arranged, in the direction of travel of the first blade bar and the second blade bar, at least partly between the first blade bar and the second blade bar, between the first blade bar and an imaginary extension of the second blade bar, between an imaginary extension of the first blade bar and the second blade bar, or between imaginary extensions of both the first blade bar and the second blade bar;

and that a first side edge and a second side edge of the third blade bar are, at the same time, in contact with side edges of the first blade bar and the second blade bar, with the side edge of the first blade bar and an imaginary extension of the side edge of the second blade bar, with an imaginary extension of the side edge of the first blade bar and the side edge of the second blade bar, or with the imaginary extensions of the side edges of both the first blade bar and the second blade bar.

The blade segment according to the invention is characterized in that said guide surface is arranged, in the direction of travel of the first blade bar and the second blade bar, at least partly between the first blade bar and the second blade bar, between the first blade bar and an imaginary extension of the second blade bar, between an imaginary extension of the first blade bar and the second blade bar, or between the imaginary extensions of both the first blade bar and the second blade bar; and that a first side edge and a second side edge of the third blade bar are, at the same time, in contact with side edges of the first blade bar and the second blade bar, with the side edge of the first blade bar and an imaginary extension of the side edge of the second blade bar, with an imaginary extension of the side edge of the first blade bar and the side edge of the second blade bar, or with the imaginary extensions of the side edges of both the first blade bar and the second blade bar.

The refining surface of a refiner for defibrating lignocellulose-containing material comprises a feed edge directed in the direction of the feed flow of the material to be refined, and a discharge edge directed in the direction of the discharge flow of the refined material. The refining surface further comprises at least one first blade bar and at least one second blade bar, between which there is a blade groove, the first and the second blade bar comprising a first end directed in the direction of the feed edge of the refining surface, and a second end directed in the direction of the discharge edge of the refining surface. The refining surface further comprises at least one third blade bar having a first end directed in the direction of the feed edge of the refining surface and a second end directed in the direction of the discharge edge of the refining surface, the first end of the third blade bar having a guide surface rising from the direction of the feed edge of the refining surface towards the direction of the discharge edge of the refining surface for guiding lignocellulose-containing material to the upper surface of the third blade bar, which guide surface has a first end directed in the direction of the feed edge of the refining surface and a second end directed in the direction of the discharge edge of the refining surface. Said guide surface is further arranged, in the direction of travel of the first blade bar and the second blade bar, at least partly between the first blade bar and the second blade bar, between the first blade bar and an imaginary extension of the second blade bar, between an imaginary extension of the first blade bar and the second blade bar, or between imaginary extensions of both the first blade bar and the second blade bar. Further, a first side edge and a second side edge of the third blade bar are, at the same time, in contact with the side edges of the first blade bar and the second blade bar, with the side edge of the first blade bar and an imaginary extension of the side edge of the second blade bar, with an imaginary extension of the side edge of the first blade bar and the side edge of the second blade bar, or with imaginary extensions of both the first blade bar and the second blade bar.

Positioning the blade bars according to the above allows such a refining surface to be provided which has no actual dams but in which the material under refining can be guided by the effect of the guide surface to the blade gap of the refiner, while the steam generated in the refining and travelling in the blade grooves and pushing, at the same time, the material under refining onwards is still capable of travelling partly past the guide surface from the blade groove between the first and the second blade bar into the blade grooves adjacent to the third blade bar. Thus, the flow of both the material to be refined and the steam is facilitated, whereby less energy goes to waste and blockages in the blade grooves are decreased.

BRIEF DESCRIPTION OF THE DRAWINGS

Some embodiments of the invention are disclosed in greater detail in the attached drawings.

For the sake of clarity, the figures show some embodiments of the invention simplified. Similar parts are denoted with the same reference numerals in the figures.

DESCRIPTION OF THE PREFERRED EMBODIMENTS

Figure 1:
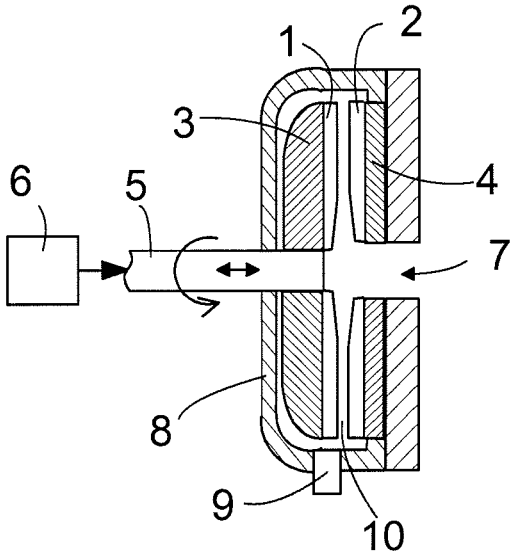
FIG. 1 shows schematically a side view in cross-section of a conventional disc refiner.

FIG. 1 shows schematically a side view in cross-section of a conventional disc refiner. The disc refiner according to FIG. 1 comprises two disc-like refining surfaces 1 and 2, which are arranged coaxially relative to each other. The first refining surface 1 is in a rotating refiner element 3, i.e. in a rotor 3 of the refiner, and the second refining surface 2 is in a fixed refiner element 4, i.e. in a stator 4 of the refiner. The refining surfaces 1 and 2 in the refiner elements 3 and 4 may be formed directly therein, or they may be formed of separate blade segments in a manner known as such. The rotor 3 of the refiner is rotated via a shaft 5 in a manner known as such by means of a motor not shown for the sake of clarity. In connection with the shaft 5, a special loader 6 is also arranged, which is connected to affect the rotor 3 via the shaft 5 in such a way that rotor 3 can be pushed towards the stator 4 to adjust a gap 10 between them, i.e. a refiner mouth 10, i.e. a blade gap 10.

The lignocellulose-containing material to be defibrated is fed via an opening 7 in the middle of the second refining surface 2 to the refiner mouth between the refining surfaces 1 and 2, where it is defibrated and refined. The lignocellulose-containing material to be defibrated may be fed to a refiner mouth also via openings in the second refining surface 2, not shown for the sake of clarity. The defibrated lingocellulose-containing material is discharged from the outer edge of the blade gap 10 between the refining surfaces 3 and 4 to the inside of a refiner chamber 8 and further out of the refiner chamber 8 along a discharge channel 9.

Figure 2:
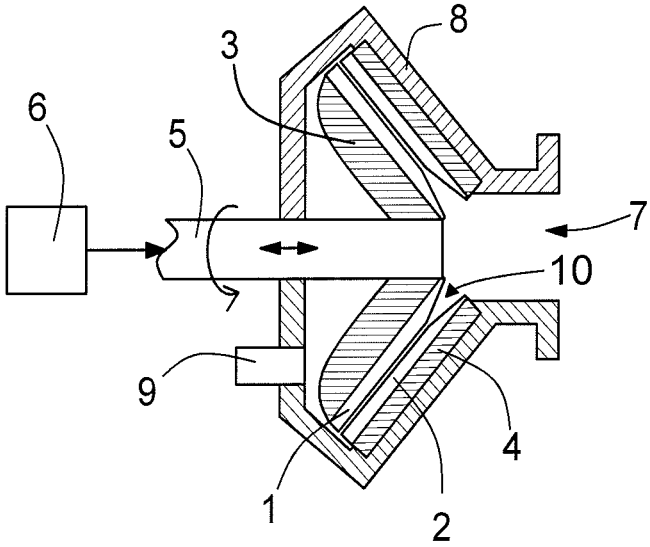
FIG. 2 shows schematically a side view in cross-section of a conventional cone refiner.

FIG. 2 shows schematically a side view in cross-section of a conventional cone refiner. The cone refiner according to FIG. 2 comprises two conical refining surfaces 1 and 2 set coaxially within each other. The first refining surface 1 is in the conical refiner element 3, i.e. in the rotor 3 of the refiner, and the second refining surface 2 is in the fixed conical refiner element 4, i.e. in the stator 4 of the refiner. The refining surfaces 1 and 2 of the refiner elements 3 and 4 may be formed either directly therein, or they may be formed of separate blade segments in a manner known as such. The rotor 3 of the refiner is rotated via the shaft 5 in a manner known as such by means of a motor not shown for the sake of clarity. In connection with the shaft 5, a special loader 6 is also arranged which is connected to affect the rotor 3 via the shaft 5 in such a way that the rotor 3 can be pushed towards the stator 4 to adjust the blade gap 10 between them.

The lignocellulose-containing material to be defibrated is fed via an opening 7 in the middle of the second refining surface 2 into the conical refiner mouth between the refining surfaces 1 and 2, where it is defibrated and refined. The defibrated lignocellulose-containg material is discharged from the outer edge of the refiner mouth between the refiner elements 3 and 4 to the inside of the refiner chamber 8 and further out of the refiner chamber 8 along a discharge channel 9.

In addition to disc refiners and cone refiners, there are also what are called disc-cone refiners where disc-like refiner elements come first in the flow direction of the material to be defibrated, after which the material to be defibrated is further refined between conical refiner elements. Furthermore, there are also cylindrical refiners where both the stator and the rotor of the refiner are cylindrical refiner elements. The general structural and operating principle of the different refiners are known as such to a person skilled in the art, so they will not be described in more detail in this context.

Figure 3:
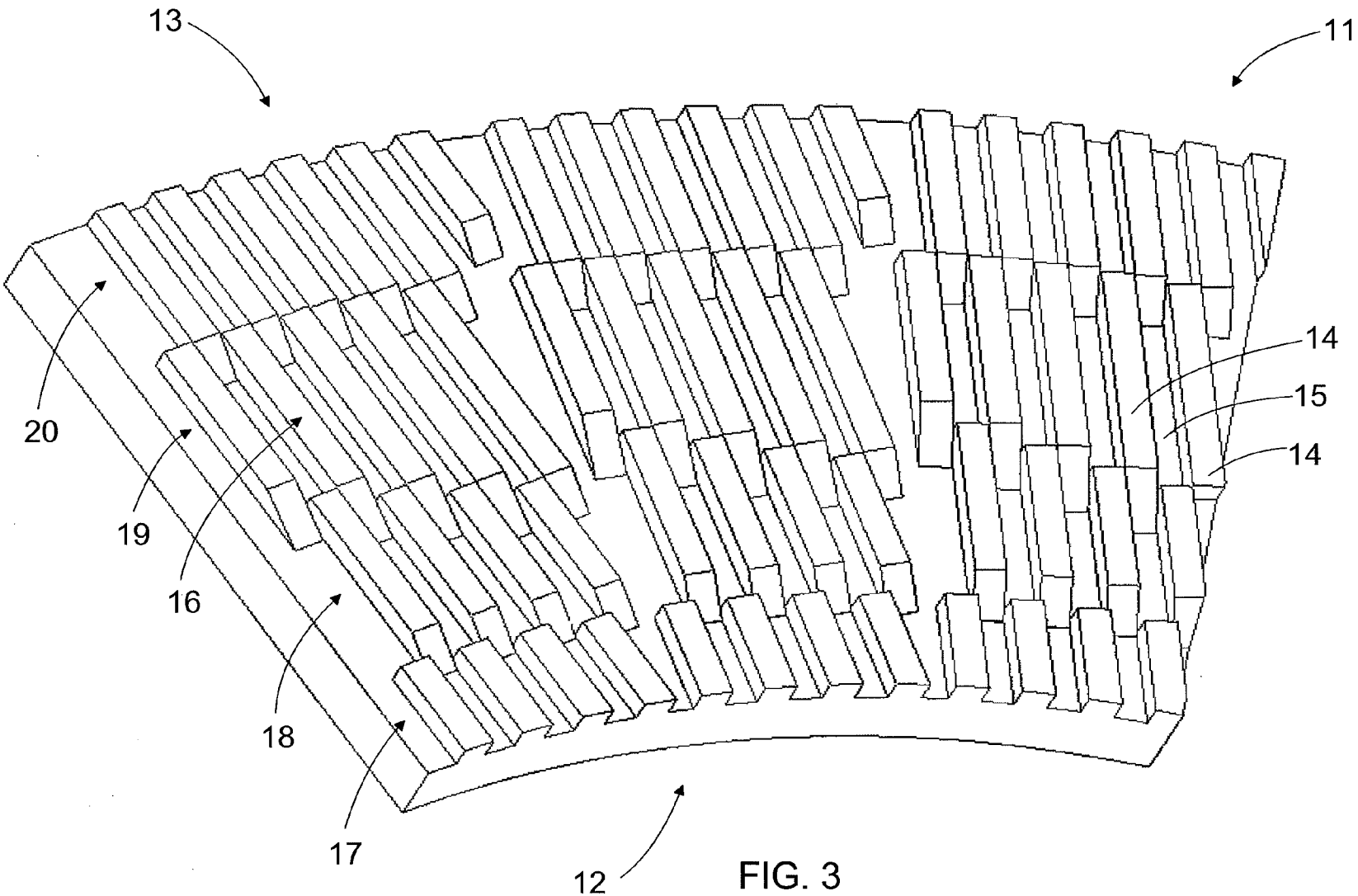
FIG. 3 shows schematically a blade segment, seen diagonally from above.

FIG. 3 shows schematically a general view of a blade segment 11 of the refining surface of a refiner, seen diagonally from above, which blade segment can be used to form a part of the whole refining surface of the stator or rotor. The blade segment 11 according to FIG. 3 comprises a feed edge 12 directed in the direction of the feed flow of the material to be refined, and a discharge edge 13 directed in the direction of the discharge flow of the refined material. When one moves along the blade segment's 11 refining surface 16, which comprises blade bars 14 and blade grooves 15 between the blade bars, in the direction of travel of the blade bars 14 from the direction of the feed edge 12 towards the direction of the discharge edge 13, the blade segment 11 according to FIG. 3 comprises four refining surface zones: a first refining surface zone 17 closest to the feed edge 12, a second refining surface zone 18 coming after that, a third refining surface zone 19 coming after the second refining surface 18, and a fourth refining surface zone 20 closest to the discharge edge 13. Generally, the whole refining surface of the refiner or the refining surface of an individual blade segment may comprise one or more refining surface zones in such a way that in one particular refining surface zone, the structure of the blade bars 14 and the blade grooves 15 of the refining surface is essentially similar across the whole refining surface zone area, while the structure of the blade bars 14 and blade grooves 15 of the refining surface typically varies between different refining surface zones.

Figure 4:
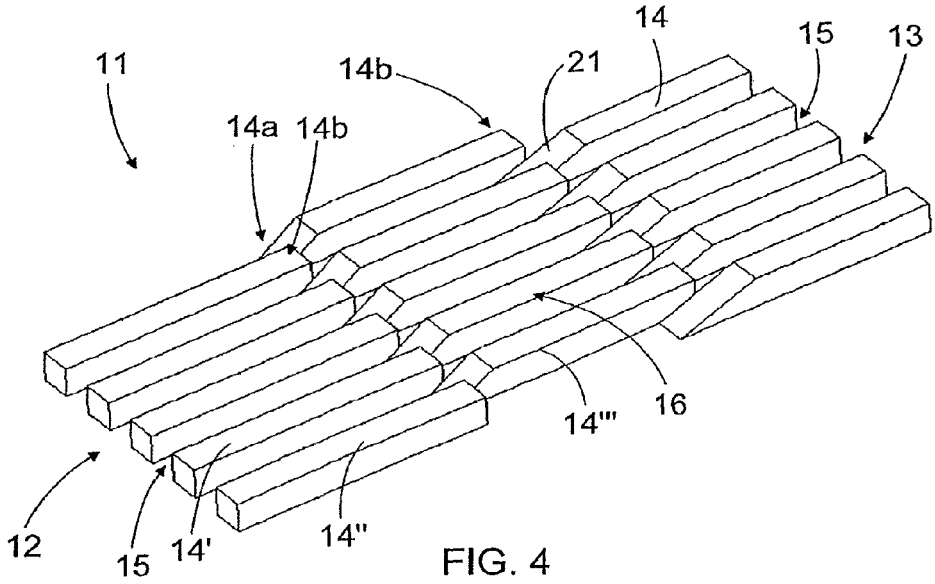
FIG. 4 shows schematically possible positioning of blade bars in a blade segment.
Figure 5:
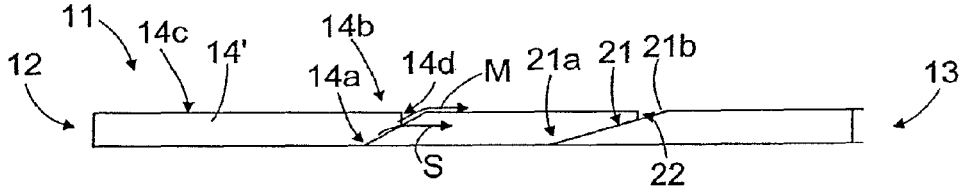
FIG. 5 shows schematically a side view of the positioning of blade bars in a blade segment according to FIG. 4.
Figure 6:
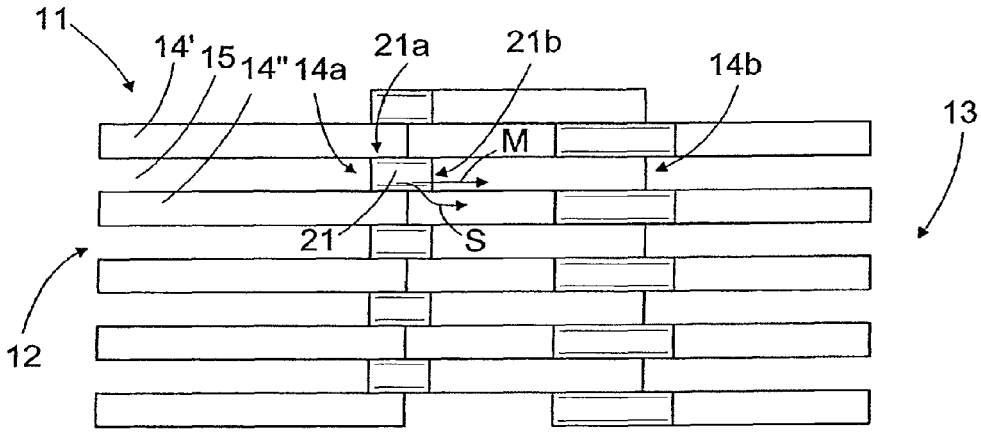
FIG. 6 shows schematically the positioning of the blade bars in a blade segment according to FIG. 4, seen from above in the direction of the refining surface.

FIG. 4 shows schematically possible positioning of the blade bars of a blade segment, seen diagonally from above; FIG. 5 shows schematically positioning of the blade bars of a blade segment according to FIG. 4, seen from one side; and FIG. 6 shows schematically positioning of the blade bars of a blade segment according to FIG. 4, seen from above in the direction of the refining surface 16. For the sake of clarity, FIGS. 4 to 6 do not show the bottom part of the blade segment. The blade segment 11 comprises a feed edge 12 directed in the direction of the feed flow of the material to be refined, and a discharge edge 13 directed in the direction of the discharge flow of the refined material. The refining surface 16 of the blade segment 11 comprises blade bars 14 and blade grooves 15 between them. Each blade bar 14 comprises a first end 14*a* and a second end 14*b*, the first end 14*a* being directed in the direction of the feed edge 12 of the refining surface 16 and the second end 14*b* being directed in the direction of the discharge edge 13 of the refining surface 16. The blade bars 14 of the refining surface 16 are arranged staggered relative to each other in such a way that when one moves along the blade groove 15 between two adjacent blade bars 14 from the direction of the feed edge 12 of the refining surface 16 towards the direction of the discharge edge 13, the blade groove 15 ends at the third blade bar 14 at its first end, where the blade bar 14 begins to rise in a ramp-like manner from the bottom of the blade groove 15 upwards. A first end 14*a* of the blade bar 14 thus comprises a guide surface 21 or surface 21 rising from the bottom of the blade groove 15 upwards. The guide surface 21 rises from the direction of the feed edge 12 of the refining surface 16 in the direction of the discharge edge 13, and the guide surface 21 comprises a first end 21*a* directed in the direction of the feed edge 12 of the refining surface 16, i.e. the end where the guide surface begins to rise from the bottom of the blade groove 15, and a second end 21*b* directed in the direction of the feed edge 13 of the refining surface 16, i.e. the end where the guide surface 21 ends at the upper surface 14*c* of the blade bar 14. In the embodiment according to FIGS. 4 to 6, the guide surface 21 is a ramp-like guide surface that rises in a linear manner, but it may also be a guide surface that rises in a convex or concave manner, or a guide surface that rises in accordance with a combination of said shapes, whereby the guide surface 21 has at least one guide surface 21 portion that rises in a linear, convex or concave manner. The first end 21*a* of the guide surface 21 of the blade bar 14, which surface begins to rise from the bottom of the groove in the direction of travel of the blade bars 14 and the blade groove 15, is positioned between two adjacent blade bars 14 in such a way that the first end 21*a* of the guide surface 21 of the blade bar 14, which surface starts in the direction of travel of the blade bars 14, is between second ends 14*b* of two adjacent blade bars 14 ending in the direction of travel of the blade bars 14. The refining surface 16 according to FIGS. 4 to 6 thus comprise blade bars 14 which are arranged, at least over part of their length, between the second ends 14*b* of adjacent blade bars 14. Hence, in the direction substantially transverse to the direction of travel of two adjacent blade bars 14, there is a portion of the third blade bar 14, which ends the blade groove 15 between the two blade bars 14 mentioned first.

The refining surface 16 of the blade segment 11 according to FIGS. 4 to 6 thus comprises at least one first blade bar 14' and at least one second blade bar 14", there being a blade groove 15 between them. Further, the refining surface 16 comprises at least one third blade bar 14'", the rising guide surface 21 of which is at least partly arranged between the first blade bar 14' and the second blade bar 14", in practice between the final ends or second ends 14*b* of the first blade bar 14' and the second blade bar 14". The rising guide surface of the third blade bar 14'" is thus arranged, in the direction of travel of the first blade bar 14' and the second blade bar 14", partly between the first blade bar 14' and the second blade bar 14", whereby the first end 14*a* of the third blade bar 14'" is arranged in the direction of the feed edge of the refining surface 16 at a distance from the second ends 14*b* of the first blade bar 14' and the second blade bar 14". In other words, in the embodiment according to FIG. 4, the distance of the second ends 14*b* of both the first blade bar 14' and the second blade bar 14" from the feed edge of the refining surface 16 is equal to and the distance of the second end 14*b* of the third blade bar 14'" from the feed edge 12 of the refining surface 16 is greater than the distance of the second end 14*b* of the first blade bar 14' and of the second end 14*b* of the second blade bar 14" from the feed edge 12 of the refining surface 16. At the same time, however, the distance of the first end 14*a* of the third blade bar 14'" from the feed edge 12 of the refining surface 16 is, in the embodiment according to FIG. 4, smaller than the distance of the second end 14*b* of the first blade bar 14' and of the second end 14*b* of the second blade bar 14" from the feed edge 12 of the refining surface 16.

The refining surface 16 according to FIGS. 4 to 6 has no dams at all but the dams are replaced by positioning blade bars 14 in such a way relative to each other that the blade groove 15 between two adjacent blade bars 14 ends at a new, starting blade bar 14, at the first end 14*a* of which a guide surface 21 rising upwards from the direction of the bottom of the blade groove 15 is formed, this guide surface ending at the upper surface 14*c* of the blade bar 14 in question. Owing to the guide surface 21, the material that travels in the blade groove 15 and is to be refined or has already undergone refining is guided back to the upper surface of the blade bars 14, into the blade gap of the refiner. Thus, the first end of the blade bar 14 in question works like a dam, guiding the material under refining into the blade gap of the refiner. Preferably, the rising guide surface 21 starts from the bottom of the blade groove 15 and ends at the upper surface 14*c* of the blade bar but it is also feasible that the first end 21*a* and/or the second end 21*b* of the guide surface have small vertical or substantially vertical portions.

The new blade bar 14'", i.e. the third blade bar 14'", starting from between two adjacent blade bars, i.e. between the first blade bar 14' and the second blade bar 14", can be positioned relative to its guide surface 21 in many different ways in the direction of travel of the first blade bar 14' and the second blade bar 14". In the embodiment of FIGS. 4 to 6, only a part of the guide surface 21 of the third blade bar 14'" is arranged between the first blade bar 14' and the second blade bar 14" in their direction of travel, whereby the final part of the guide surface 21 of the third blade bar 14'" continues after the first blade bar 14' and the second blade bar 14" have ended in their direction of travel. Thus, between the second end 14*b* of the first blade bar 14' and the first end 14*a* of the third blade bar 14" as well as between the second end of the second blade bar 14" and the first end 14*a* of the third blade bar 14'", there remains a slot 22 or an open portion 22. Such positioning of the blade bars provides a solution where the material under refining rises, due to the effect of the guide surface 21, into the blade gap of the refiner but where the steam generated in the refining and travelling in the blade grooves 15 and simultaneously pushing material under refining onwards can partly flow past the guide surface 21 into the blade grooves 15 adjacent to the third blade bar 14'". Thus, not much of the steam generated in the refining is guided into the blade gap but the steam is able to flow more freely than when conventional dams are used. Compared with a conventional half-dam which facilitates the flow of steam and whose upper surface is at a lower level than the upper surface 14*c* of the blade bars 14, the present solution provides, nevertheless, an effect of guiding material under refining into the blade gap in an improved manner because as the material under refining is heavier than steam, it flows from the blade groove 15 directly onwards along the guide surface 21 into the blade gap between the refining surfaces. In FIGS. 5 and 6, the passing of the material under refining on the refining surface is shown schematically by an arrow denoted with reference M, and the passing of the steam on the refining surface is shown schematically by an arrow denoted with reference S.

Figure 13:
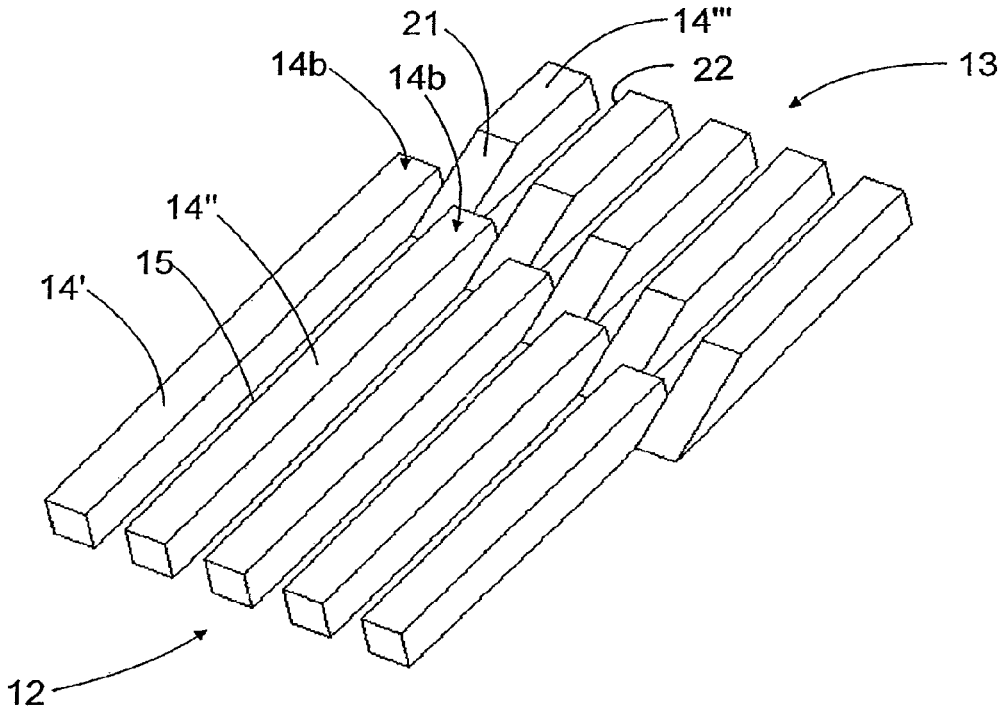
FIG. 13 shows schematically a sixth possible positioning of blade bars relative to each other, seen diagonally from above.

FIG. 13 shows, diagonally from above, such reciprocal positioning of the blade bars 14 which resembles the solution according to FIG. 4 in such a way that a slot 22 remains on both sides of the guide surface of the third blade bar 14'" but which deviates from the embodiment shown in FIG. 4 in such a way that the sizes of the slot 22 on different sides of the guide surface 21 of the third blade bar 14'" deviate from each other. This is achieved by arranging the first blade bar 14' and the second blade bar 14" in such a way relative to each other that the second ends 14*b* of the first blade bar 14' and the second blade bar 14" are at different distances from the feed edge 12 of the refining surface 16.

What is called "open staggering" of the blade bars 14, i.e. staggering where there is a slot 22 on both sides of the guide surface 21 of the third blade bar 14'", as described above, can be used for instance when refining chips in inner refining surface zones, i.e. refining surface zones closer to the feed of the material to be refined. In this area, blade bars need not be densely positioned because the material to be refined is still in relatively large pieces. What is important, however, is to guarantee unrestricted flow of the material to be refined farther into the blade gap, which is promoted by open staggering as the structure facilitating the flow of steam.

Changing the staggering depth of the blade bars 14, i.e. how far the first end 14*a* of the third blade bar 14'" extends to the space between the first blade bar 14' and the second blade bar 14", and the angle of elevation of the guide surface 21 at the first end 14*a* of the blade bar 14 allows the size of the slots 22 between the ends of the blade bars 14 and thus the steam flows on the refining surface 16 to be affected. The angle of elevation of the guide surface 21 relative to the upper surface 14*c* of the blade bar 14 may vary between 20 and 55 degrees, for example, preferably between 30 and 45 degrees. The smaller the angle of elevation of the guide surface 21 is, the larger part of the steam flow travelling in the blade groove moves into the blade grooves adjacent to the blade bar. In the portion on the side of the feed edge of the refining surface, a gentler angle of elevation can be used for the guide surface, and in the refining surface zones following it, i.e. in zones performing more intense refining, it is preferable to use a steeper angle of elevation of the guide surface. A gentle angle of elevation of the guide surface combined with closed or nearly closed staggering of the blade bars, which is described in the following, in zones that perform more intense refining takes too much volume and may lead to steam flowing problems.

Figure 11:
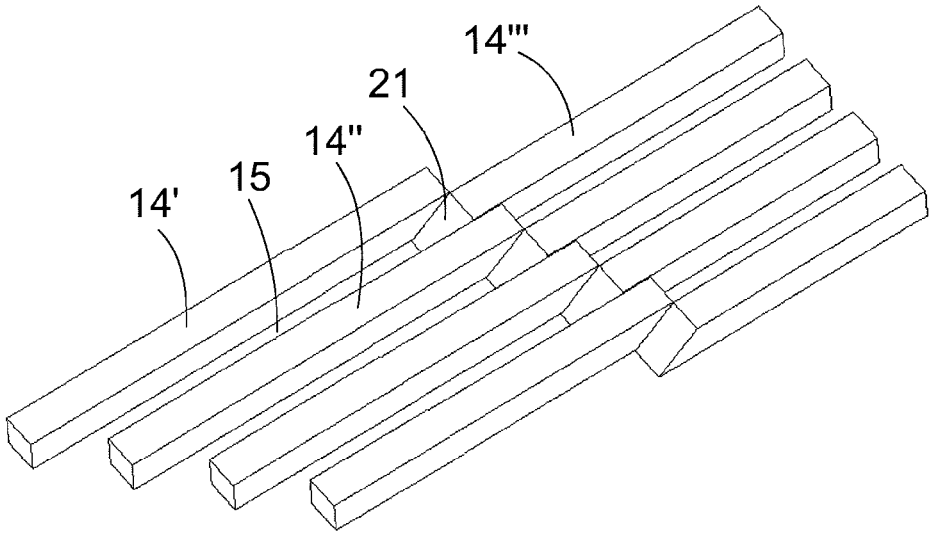
FIG. 11 shows schematically a fourth possible positioning of blade bars relative to each other, seen diagonally from above.

Further, deviating from FIGS. 4 to 6, the guide surface 21 of the starting blade bar, i.e. the third blade bar 14''', may also be positioned completely between two ending blade bars 14, i.e. between the first blade bar 14' and the second blade bar 14'', whereby no slot 22 remains on either side of the guide surface 21. Such an application may be used in disc refiners, for example, but also in other refiner types close to the discharge edge of the blade segment or refining surface, where it may be desirable to restrict the flow of the material under refining onwards to boost the refining of the material and to guarantee that all material will rise from the bottom of the blade grooves 15 into the blade gap 10. Such reciprocal positioning of the blade bars 14 is shown schematically and diagonally from above in FIG. 11.

In refiner applications where a lot of steam is generated in the blade gap 10 of the refiner, the first end 14*a* of the third blade bar 14''' may be arranged relative to the second ends 14*b* of the first blade bar 14' and the second blade bar 14'' in such a way that the slots 22 between the ends of the blade bars become relatively large, as a result of which the flow of steam past the guide surface 21 of the third blade bar 14''' is boosted. Thus, the first end 21*a* of the guide surface 21 of the third blade bar 14''' can be positioned, in the direction of travel of the first blade bar 14' and the second blade bar 14'', at the point where the first blade bar 14' and the second blade bar 14'' end or even at a point which is, in the direction of travel of the first blade bar 14' and the second blade bar 14'', at a distance from the second ends 14*b* of the first 14' and the second 14'' blade bar, whereby the third blade bar 14''' is arranged between imaginary extensions of both the first blade bar 14' and the second blade bar 14'' in the direction of travel of the first 14' and the second blade bar 14''. Hence, the direction of travel of the first blade bar 14' and the second blade bar 14'' means the direction of the tangent of the first blade bar 14' and the second blade bar 14'' at the second end 14*b* of the first blade bar 14' and the second blade bar 14''.

Figure 7:
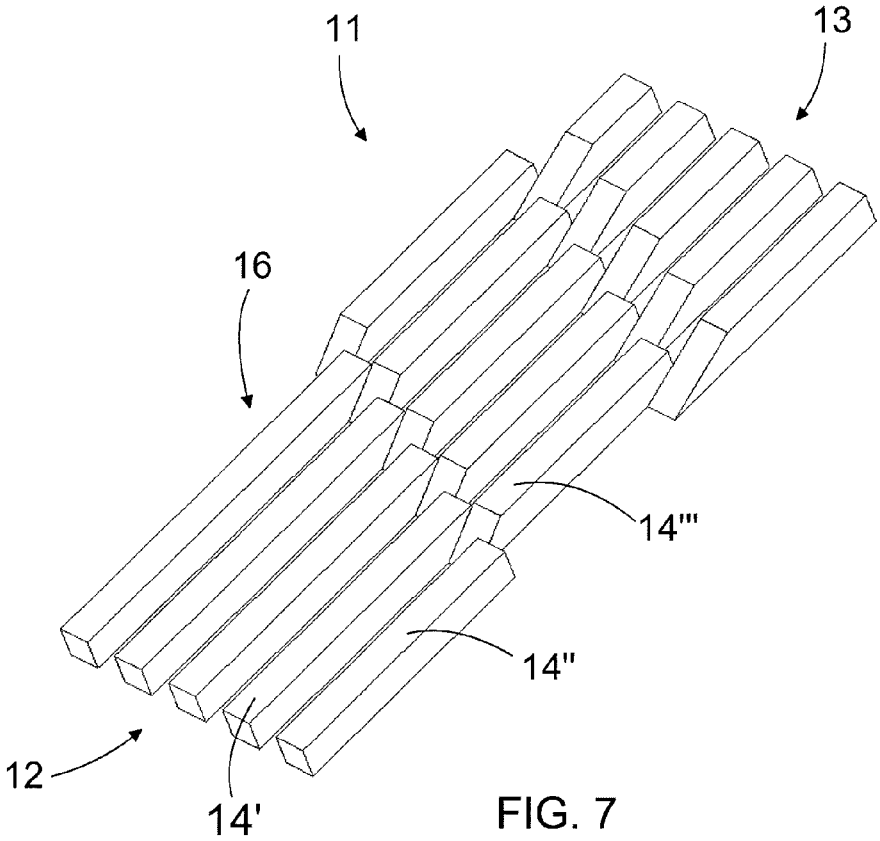
FIG. 7 shows schematically a second possible positioning of blade bars in a blade segment, seen diagonally from above.
Figure 8:
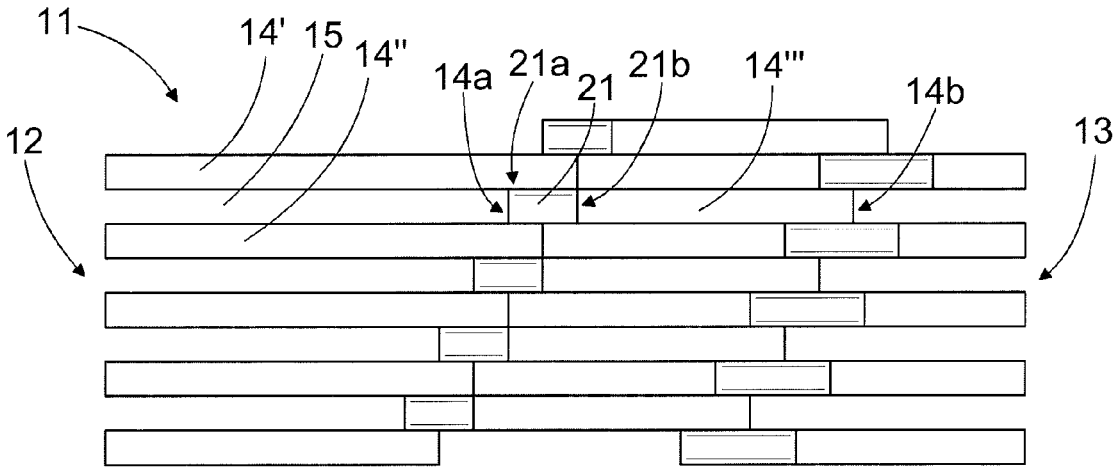
FIG. 8 shows schematically the positioning of blade bars in a blade segment according to FIG. 7, seen from above in the direction of the refining surface.

The embodiment according to FIGS. 4 to 6 shows what is called "straight staggering", where the first ends 14*a* and the second ends 14*b* of two adjacent blade bars 14 are at substantially the same distance from the feed edge 12 of the refining surface 16. The embodiment according to FIGS. 7 and 8, in turn, shows what is called "oblique staggering" where the first ends 14*a* and the second ends 14*b* of two adjacent blade bars 14 are at different distances from the feed edge 12 of the refining surface 16. This is achieved in the embodiment shown in FIGS. 7 and 8, for example, in such a way that the first blade bar 14' is arranged to end farther from the feed edge 12 of the refining surface 16 than the second blade bar 14''; in other words the second end 14*b* of the first blade bar 14' is farther from the feed edge 12 of the refining surface 16 than the second end 14*b* of the second blade bar 14''. When a constant angle is used on the guide surface 21 of the third blade bar 14''', as shown in FIG. 7, the slot 22 between the second end 14*b* of the first blade bar 14' and the first end 14*a* of the third blade bar 14''' becomes smaller than the slot 22 between the second end 14*b* of the second blade bar 14'' and the first end 14*a* of the third blade bar 14'''. With such a solution, it is possible to avoid a decrease in the open flow area in all blade grooves 15 of the refining surface 16 at the same distance from the feed edge 12 of the refining surface 16. Thus, on one side of the starting blade bar, i.e. the third blade bar 14''', a larger slot 22 is formed than on the other side. Such an embodiment is thus also feasible where there is not necessarily any kind of slot 22 on one side of the third blade bar 14'''. Then, the distance of the second end 14*b* of the first blade bar 14' from the feed edge 12 of the refining surface 16 is greater than the distance from the second end 14*b* of the second blade bar 14'' from the feed edge 12 of the refining surface 16, and the distance of the second end 21*b* of the guide surface 21 of the third blade bar 14''' from the feed edge 12 of the refining surface 16 may be smaller than or equal to the distance of the second end 14*b* of the first blade bar 14' from the feed edge 12 of the refining surface 16. Further, the distance of the second end 21*b* of the guide surface 21 of the third blade bar 14''' from the feed edge 12 of the refining surface 16 is, however, greater than the distance of the second end 14*b* of the second blade bar 14'' from the feed edge 12 of the refining surface 16. The distance of the first end 21*a* of the guide surface 21 of the third blade bar 14''' from the feed edge of the refining surface may, in turn, be greater than, smaller than or equal to the distance of the second end 14*b* of the second blade bar 14'', depending on the embodiment.

In such "oblique staggering", it is possible to stagger the blade bars relative to each other also in such a way that the first end 21*a* of the guide surface 21 of the third blade bar 14''' may be positioned, in the direction of travel of the first blade bar 14' or the second blade bar 14'', at the point where the first blade bar 14' or the second blade bar 14'' ends, or even at a point which is, in the direction of travel of the first blade bar 14' or the second blade bar 14'', at a distance from the second end 14*b* of the first 14' or the second 14'' blade bar, whereby the third blade bar is arranged, at least over part of its length, either between the first blade bar 14' and an imaginary extension of the second blade bar 14'' or between an imaginary extension of the first blade bar 14' and the second blade bar 14'' in the direction of travel of the first 14' and the second blade bar 14''. Thus, the direction of travel of the first blade bar 14' or of the second blade bar 14' means the tangential direction of the first blade bar 14' or the second blade bar 14'' at the second end 14*b* of the first blade bar 14' or the second blade bar 14''.

Figure 12:
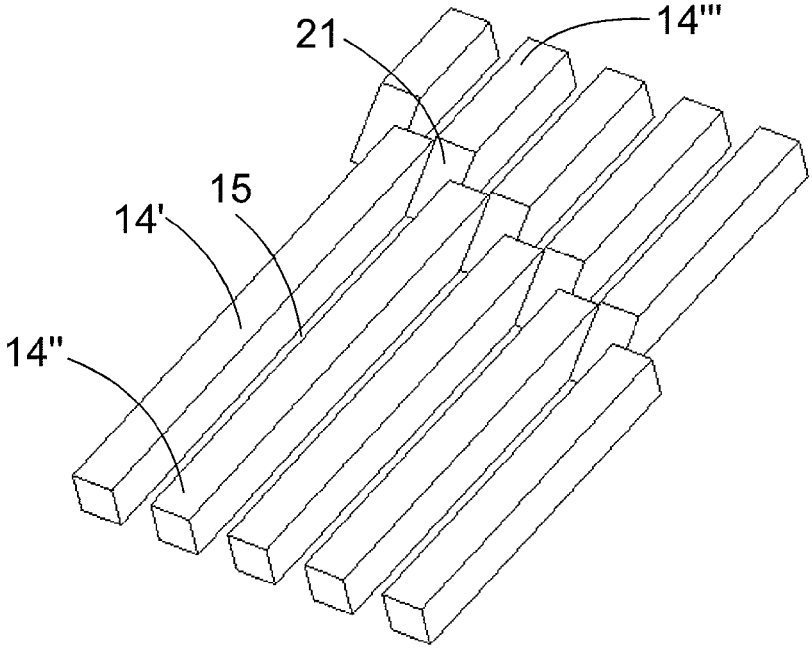
FIG. 12 shows schematically a fifth possible positioning of blade bars relative to each other, seen diagonally from above.

FIG. 12 further shows schematically and diagonally from above such reciprocal positioning of the blade bars where no slot is formed between the guide surface 21 of the first blade bar 14' and the third blade bar 14''' but where a slot 22 is formed between the second blade bar 14'' and the guide surface 21 of the third blade bar 14'''. In such an embodiment, half-open staggering may be formed with the blade bars 14', 14'' and 14'''.

When it is desirable to achieve the most efficient refining possible, that half of the third blade bar 14''' where the slot 22 is smaller or where there is no slot 22 at all may be positioned, in the case of a rotating refining surface, i.e. the rotor of the refiner, in an opposite direction relative to the direction of rotation of the rotor, i.e. farther behind in the direction of rotation. In the case of a stationary refining surface, i.e. the stator of the refiner, that half of the third blade bar 14''' where the slot 22 is smaller or where there is no slot 22 at all may be positioned in the same direction with the rotation direction of the rotor, i.e. on that side of the blade bar which is the last one to meet the rotor. Thus, that half of the guide surface 21 of the third blade bar 14''' where the slot 22 is smaller or where there is no slot at all lifts material under refining more efficiently from the blade groove into the blade gap between the refining surfaces. Simultaneously, on that side of the guide surface 21 of the third blade bar 14''' where the slot 22 is larger, the steam can flow more freely from one blade groove to another.

In the case of the refining surface of a stator, a phenomenon characteristic of stators, i.e. the back flow of steam in a given area on the refining surface of the stator, may be taken into account when arranging the blade bars relative to each other. This back flow of steam may be taken into account by staggering the blade bars relative to each other and setting the angle of elevation of the guide surface of the blade bar such that the steam cannot flow on the refining surface back from the slots between the blade bars but that it turns upwards thanks to a wall 14*d* at the second end 14*b* of the blade bar. Such a solution implemented on the refining surface of the stator makes it possible to further boost the refining.

Figure 9:
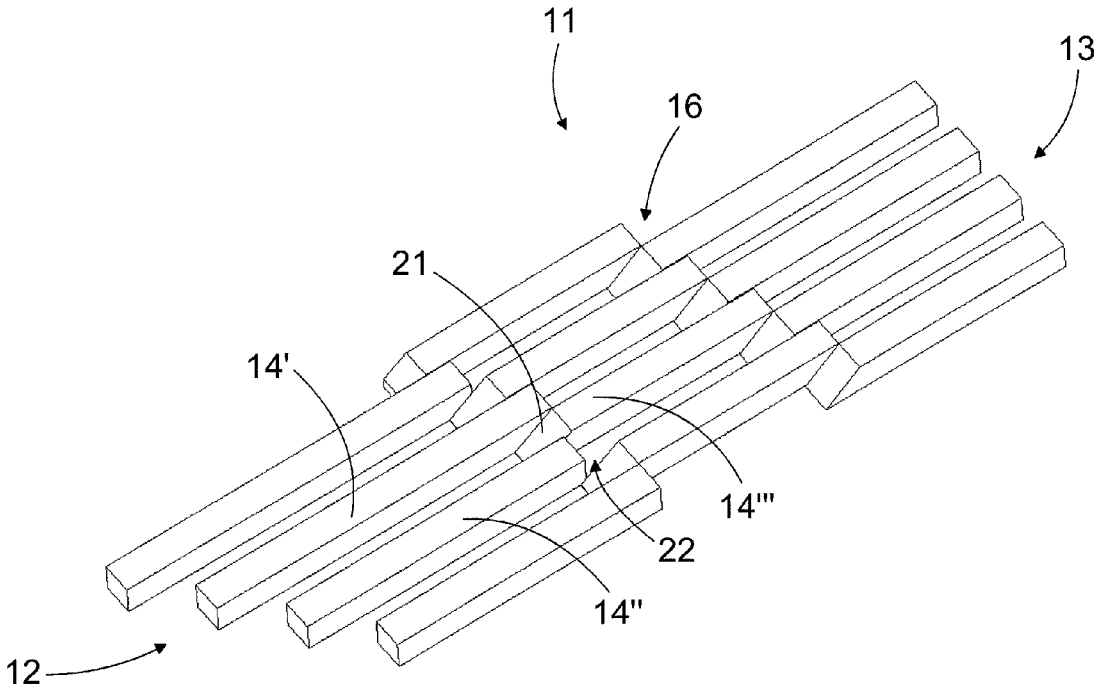
FIG. 9 shows schematically a third possible positioning of blade bars in a blade segment, seen diagonally from above.
Figure 10:
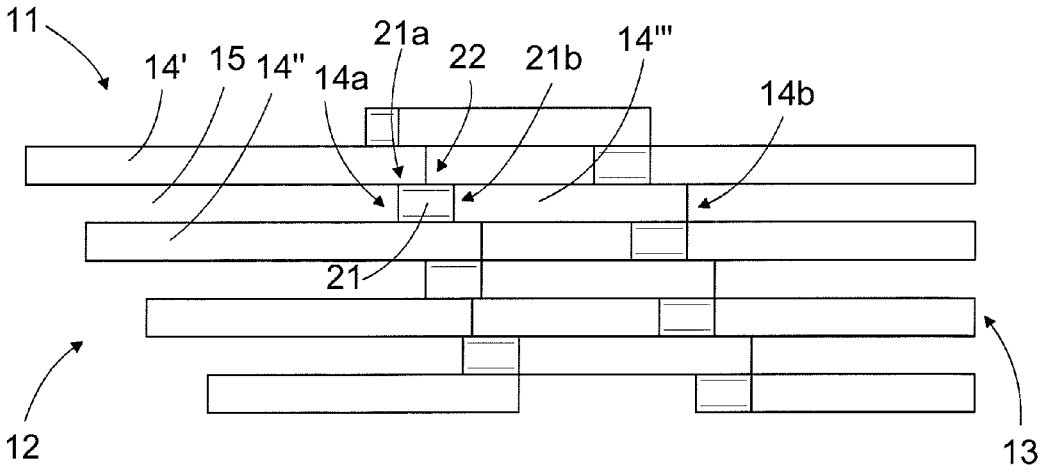
FIG. 10 shows schematically the positioning of blade bars in a blade segment according to FIG. 9, seen from above in the direction of the refining surface.

FIGS. 9 and 10 show schematically yet one possible way of positioning the blade bars of the blade segment. The blade segment in FIGS. 9 and 10 shows a solution where one blade segment comprises a plurality of blade bars staggered in different ways relative to each other by varying the sizes or extensions of the slots 22 between the blade bars on different sides of the blade bars in different ways presented earlier.

Blade segments 11 may be used to form a part of the refining surface of the refiner in such a way that the feed edge 12 of the blade segment 11 corresponds to the feed edge of the whole refining surface and that the discharge edge 13 of the blade segment 11 corresponds to the discharge edge of the whole refining surface, whereby the blade bars 14 and the blade grooves 15, which are at the same distance from the feed edge 12 of the refining surface, belong to the same refining surface zone. However, the blade segments 11 may be used to form only a part of one refining surface zone of the refining surface, i.e. a part of the first 17, the second 18, the third 19 or the fourth 20 refining surface zone of the refining surface, shown in an exemplary manner in FIG. 3.

In the figures, various embodiments are shown by using the refining surface of a blade segment as an example but all of the various embodiments may also be applied to a refining surface implemented as a continuous refining surface structure.

In some cases, features disclosed in the description may be used as such, irrespective of other features. On the other hand, features disclosed in the description may, if required, be combined to form various combinations.

The drawings and the related description are only intended to illustrate the idea of the invention. Details of the invention may vary within the scope of the claims.

The structures of the blade bars 14 shown in the figures are straight but the blade bars 14 could also have a curved longitudinal structure. Further, the blade bars may be arranged to be either pumping or feeding blade bars, i.e. blade bars promoting the passage of the material to be refined on the refining surface, or retaining blade bars, i.e. blade bars restricting the passage of the material to be refined on the refining surface, or a combination thereof.

A pumping blade bar means a blade bar which produces for a pulp particle to be refined both a speed component in the circumferential direction of the refining surface, i.e. in the direction of the perpendicular of the blade segment radius, and a speed component in the direction of the refining surface radius, directed from the feed edge of the refining surface towards the discharge edge of the refining surface. A retaining blade bar means a blade bar which produces for a pulp particle to be refined both a speed component in the circumferential direction of the refining surface, i.e. in the direction of the perpendicular of the blade segment radius, and a speed component in the direction of the refining surface radius, directed from the discharge edge of the refining surface towards the feed edge of the refining surface. For example, when the blade surface of FIG. 3 is viewed the right way up, i.e. in such a way that its reference numerals are seen in a normal upright position, the blade bars closest to the left edge are in the radial direction of the blade segment, whereby they are neither pumping nor retaining blade bars but radial blade bars. Correspondingly, the blade bars closest to the right edge in FIG. 3 form such an angle with the radial direction of the blade segment which opens from the feed edge of the blade surface towards the discharge edge of the blade surface. Thus, the blade bars closest to the right edge may be pumping or retaining. If the blade segment of FIG. 3 is a stator blade segment and the rotor moves over it from right to left, the blade bars closest to the right edge are pumping, promoting thus radial movement of the material from the feed edge to the discharge edge. Correspondingly, if the blade segment of FIG. 3 is a stator blade segment and the rotor moves over it from left to right, the blade bars closest to the right edge are retaining, retaining thus radial movement of the material from the feed edge to the discharge edge. If the blade segment of FIG. 3 is a rotor blade segment and moves from left to right, the blade bars closest to the right edge are pumping, promoting thus radial movement of the material from the feed edge to the discharge edge. Further, if the blade segment of FIG. 3 is a rotor blade segment and moves from right to left, the blade bars closest to the right edge are retaining, restraining thus radial movement of the material from the feed edge to the discharge edge.

The blade segment of FIG. 3 shows one example of the directions of the blade bars in connection with the blade solution disclosed. The solution disclosed works best when both the rotor and the stator have blade bar angles that pump to some extent. This is because the slot improving the steam flow is then directed in the blade gap more forwards, which is the direction in which the steam is supposed to go, and because the ramp-like structure of the invention is then directed closer to the direction in which the pulp flow is travelling in reality. Thus, the pulp rises efficiently into the blade gap. The solution works best when the angles of the blade bars of both the rotor and the stator are 10 to 45 degrees pumping. Further, the solution works well when the angles of the blade bars are 0 to 10 degrees pumping or more than 45 degrees pumping or 0 to 15 degrees braking, i.e. retaining. When the blade bar angles of the rotor are intensely pumping, in other words when the blade bar angles of the rotor are for instance 25 to 45 degrees pumping or have even greater blade bar angles, also such a solution works where the blade bar angles of the stator are 15 to 45 degrees pumping, for example. The solution does not impose other restrictions on the blade bar angles used for blade surfaces of the stator and the rotor or for parts thereof, so the blade angles can be selected basically freely in different combinations for the blade surfaces of the rotor and the stator.

With selection of the blade bar angles it is possible to have an influence on how much energy the blade arrangement consumes and what the change in the refining degree achieved with the refining is like. An intensely pumping blade solution leads to a short retention time of the material in the blade gap, whereby the refining consumes little energy. Thus, uniform refining treatment is achieved for the material to be refined but the change in the refining degree remains relatively small. With a blade solution that pumps less, the material remains longer in the blade gap, whereby the energy consumption of the refining is greater, and a greater change in the refining degree is achieved. If an intensely retaining blade solution is used, the retention time of the refining is long, resulting in high energy consumption. Thus, a great change in the refining degree is achieved on average but the refining degree of the refined material may be non-uniform, comprising material refined to a great extent and material refined to a small extent.

Further, in all embodiments according to FIGS. 3 to 13, the edges of the third blade bar 14''' are in contact with the first blade bar 14' and the second blade bar 14''. However, such a solution is also feasible where there is a small slot between the first blade bar 14' and the third blade bar 14''' and/or the second blade bar 14" and the third blade bar 14''' in such a way that the third blade bar 14''' is not, at least in its starting part, as wide as the blade groove 15 which is terminated by the third blade bar 14''', whereby steam can flow through this slot from one blade groove into another. Such a solution is also feasible where the guide surface of the third blade bar is at the bottom of the blade groove in contact with the adjoining blade bars but by its upper part off the side surfaces of either or both of the adjacent blade bars, whereby the upper surface 14*c* of the third blade bar 14''' would be narrower than the starting part of its guide surface 21.

Figure 14:
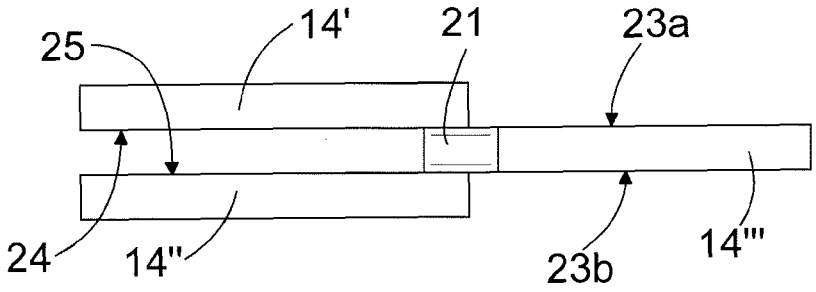
FIGS. 14 to 17 show yet some other ways of positioning blade bars relative to each other.

As noted above, in the embodiments according to FIGS. 3 to 13, the third blade bar 14''' is by its side edges in contact with the first blade bar 14' and the second blade bar 14". This is further illustrated in FIG. 14, where a first side edge 23*a* of the third blade bar 14''' is in contact with the first blade bar's 14' side edge 24 facing the side edge 23*a* and where a second side edge 23*b* of the third blade bar 14''' is further in contact with the second blade bar's 14" side edge 25 facing the side edge 23*b*.

Figure 15:
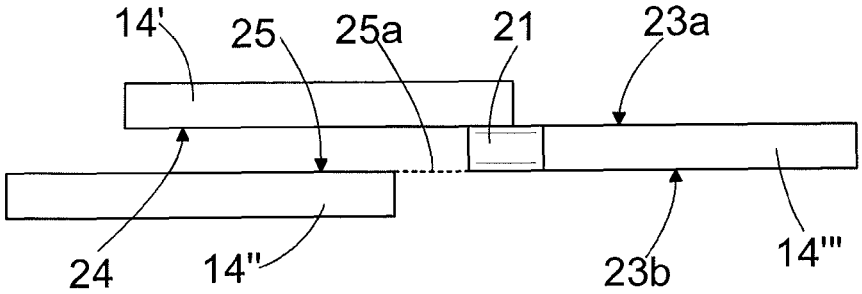

Further, when the guide surface 21 of the third blade bar 14''' is arranged, in the direction of travel of the first blade bar 14' and the second blade bar 14", between the first blade bar 14' and an imaginary extension of the second blade bar 14", as schematically shown in FIG. 15, the first blade bar 14', the second blade bar 14" and the third blade bar 14''' can be arranged in such a way relative to each other that the first side edge 23*a* of the third blade bar 14''' is in contact with the first blade bar's 14' side edge 24 facing the side edge 23*a*, and the second side edge 23*b* of the third blade bar 14''' is in contact with an imaginary extension 25*a* of the side edge 25 of the second blade bar 14", which imaginary extension faces the side edge 23*b*.

Figure 16:
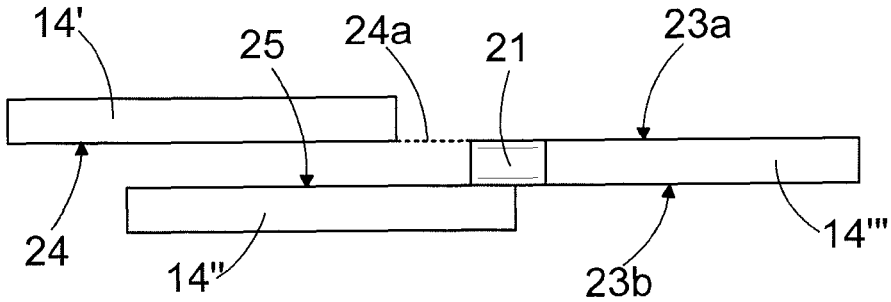

Also when the guide surface 21 of the third blade bar 14''' is arranged, in the direction of travel of the first blade bar 14' and the second blade bar 14", between an imaginary extension of the first blade bar 14' and the second blade bar 14", as schematically shown in FIG. 16, the first blade bar 14', the second blade bar 14" and the third blade bar 14''' can be arranged in such a way relative to each other that the first side edge 23*a* of the third blade bar 14''' is in contact with an imaginary extension 24*a* of the side edge 24 of the first blade bar 14', which imaginary extension faces the side edge 23*a*, and that the second side edge 23*b* of the third blade bar 14''' is in contact with the second blade bar's 14" side edge 25 facing the side edge 23*b*.

Figure 17:
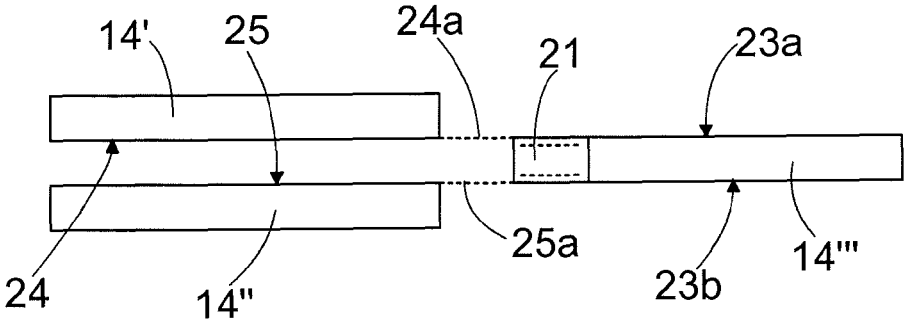

Further, when the guide surface 21 of the third blade bar 14''' is arranged, in the direction of travel of the first blade bar 14' and the second blade bar 14", between imaginary extensions of the first blade bar 14' and the second blade bar 14", as schematically shown in FIG. 17, the first blade bar 14', the second blade bar 14" and the third blade bar 14''' can be arranged in such a way relative to each other that the first side edge 23*a* of the third blade bar 14''' is in contact with the imaginary extension 24*a* of the side edge 24 of the first blade bar 14', which imaginary extension faces the side edge 23*a*, and that the second side edge 23*b* of the third blade bar 14''' is in contact with the imaginary extension 25*a* of the side edge 25 of the second blade bar 14", which imaginary extension faces the side edge 23*b*.

The side edges 23*a*, 23*b* of the third blade bar 14''' being in contact with the side edges 24, 25 of the first blade bar 14' and/or the second blade bar 14' or with imaginary extensions thereof thus means herein that the third blade bar 14''' is at least over some longitudinal portion thereof or over the whole longitudinal portion thereof as wide as that blade groove 15 or an imaginary extension of that blade groove 15 which is terminated by the third blade bar 14'''. The side edges 23*a*, 23*b* of the third blade bar 14''' can be in contact with side edges 24, 25 of the first blade bar 14' and/or the second blade bar 14' or imaginary extensions thereof only by the lower part of the blade bars 14', 14", 14''' or over the whole height thereof, depending on the desired proportion of control for the flow of the material to be refined and the steam generated during the refining, for example.

The larger the portion over which the side edges 23*a*, 23*b* of the third blade bar 14''' are in contact with the side edges 24, 25 of the first blade bar 14' and the second blade bar 14" in the elevational direction, the higher proportion of the material travelling in the blade gap can be guided preferably into the blade gap. However, it is preferable for the solution that although in contact with the side edges 24, 25 of the first blade bar 14' and the second blade bar 14", the side edges 23*a*, 23*b* of the third blade bar 14''' do not completely shut off the passage of steam, at least not into one of the adjacent grooves. This has been implemented in the solution in such a way that the side edges 23*a*, 23*b* of the third blade bar are in contact with the side edges of the first blade bar 14' and the second blade bar 14" only by the lower part, or in such a way that the guide surface 21 of the third blade bar 14''' is not yet in its full height at the point of the second end 14*b* of the first blade bar 14' and/or the second blade bar 14", or in such a way that at least one of the side edges 23*a*, 23*b* of the third blade bar 14''' is in contact with only the imaginary extension 24*a*, 25*a* of the side edge of the first blade bar 14' or the second blade bar 14".

The invention claimed is:

1. A refining surface structure of a refiner for defibrating lignocellulose-containing material comprising:

wherein the refining surface structure has a feed edge for receiving a feed flow of the lignocellulose-containing material to be refined and a discharge edge for discharging a refined lignocellulose-containing material, the discharge edge spaced from the feed edge;

wherein a first direction is defined toward the discharge edge from the feed edge;

wherein a second direction is defined toward the feed edge from the discharge edge;

wherein the refining surface structure has at least one first blade bar and at least one second blade bar, the first blade bar and the second blade bar defining a blade groove therebetween, wherein each of the first blade bar and the second blade bar has a side edge abutting the groove, wherein the first blade bar and the second blade bar define a direction of travel;

wherein the first blade bar and the second blade bar have first ends directed in the second direction toward the feed edge of the refining surface structure and second ends directed in the first direction toward the discharge edge of the refining surface structure;

wherein the refining surface structure further comprises at least one third blade bar having a first end directed in the second direction toward the feed edge of the refining surface structure, and a second end directed in the first direction toward the discharge edge of the refining surface structure, and a first side edge and a second side edge and an upper surface therebetween;

wherein the first end of the third blade bar forms a guide surface starting at a first end of said guide surface in the second direction toward the feed edge of the refining surface structure and rising to a second end in the first direction toward the discharge edge of the refining surface structure so as to guide the lignocellulose-containing material to the upper surface of the third blade bar;

wherein the third blade bar is at most partly between the first blade bar and the second blade bar such that there is a groove on either side of the third blade bar which is not part of the blade groove defined between the first blade bar and the second blade bar;

wherein said guide surface is arranged in the direction of travel of the first blade bar and the second blade bar, and the guide surface is further arranged:

at least partly between the first blade bar and the second blade bar, or between the first blade bar and an imaginary extension of the second blade bar; or between an imaginary extension of the first blade bar and the second blade bar; or between the imaginary extensions of both the first blade bar and the second blade bar; and wherein the first side edge and the second side edge of the third blade bar are, at the same time, in contact with either:

the side edge of the first blade bar and the side edge of the second blade bar, or the side edge of the first blade bar and an imaginary extension of the side edge of the second blade bar, or an imaginary extension of the side edge of the first blade bar and the side edge of the second blade bar; or the imaginary extensions of both the first blade bar and the second blade bar.

2. The refining surface structure of claim 1 wherein the second end of the first blade bar is spaced from the feed edge of the refining surface a distance substantially equal to a distance the second end of the second blade bar is spaced from the feed edge of the refining surface; and wherein the second end of the guide surface of the third blade bar is spaced a distance from the feed edge of the refining surface that is equal to or greater than the distances the second end of the first blade bar and the second end of the second blade bar are spaced from the feed edge of the refining surface.

3. The refining surface structure of claim 2 wherein the first end of the guide surface of the third blade bar is spaced a distance from the feed edge of the refining surface that is equal to or greater than the distances the second end of the first blade bar and the second end of the second blade bar are spaced from the feed edge of the refining surface.

4. The refining surface structure of claim 2 wherein the distance of the first end of the guide surface of the third blade bar from the feed edge of the refining surface is less than the distances the second end of the first blade bar and the second end of the second blade bar are spaced from the feed edge of the refining surface.

5. The refining surface structure of claim 1 wherein the second end of the first blade bar is spaced from the feed edge of the refining surface a distance substantially equal to a distance the second end of the second blade bar is spaced from the feed edge of the refining surface; and wherein the second end of the guide surface of the third blade bar is spaced a distance from the feed edge of the refining surface that is less than the distances the second end of the first blade bar and the second end of the second blade bar are spaced from the feed edge of the refining surface.

6. The refining surface structure of claim 1, wherein the second end of the first blade bar is spaced from the feed edge of the refining surface a distance greater than a distance the second end of the second blade bar is spaced from the feed edge of the refining surface; and wherein the second end of the guide surface of the third blade bar is spaced a distance from the feed edge of the refining surface that is less than or equal to the distance the second end of the first blade bar is spaced from the feed edge, and the distance of the second end of the guide surface of the third blade bar from the feed edge is greater than the distance the second end of the second blade bar is spaced from the feed edge.

7. The refining surface structure of claim 6, wherein the first end of the guide surface of the third blade bar is spaced a distance from the feed edge of the refining surface that is greater than the distance the second end of the second blade bar is spaced from the feed edge of the refining surface.

8. The refining surface structure of claim 6, wherein the first end of the guide surface of the third blade bar is spaced a distance from the feed edge of the refining surface that is less than or equal to the distance of the second end of the second blade bar from the feed edge of the refining surface.

9. The refining surface structure of claim 1 wherein the guide surface comprises at least one portion rising in a linear, concave or convex manner.

10. The refining surface structure of claim 1 wherein the blade groove has portions defining blade groove bottom and wherein the guide surface rises in a linear manner from the bottom of the blade groove at an angle of elevation of the guide surface relative to the bottom of the blade groove which is between 30 to 45 degrees.

11. A blade segment for a refiner for defibrating lignocellulose-containing material comprising:

wherein the blade segment has a refining surface, and the refining surface has a feed edge for receiving a feed flow of the lignocellulose-containing material to be refined and a discharge edge for discharging a refined lignocellulose-containing material, the discharge edge spaced from the feed edge;

wherein a first direction is defined toward the discharge edge from the feed edge;

wherein a second direction is defined toward the feed edge from the discharge edge;

wherein the refining surface of the blade segment has at least one first blade bar and at least one second blade bar, the first blade bar and the second blade bar defining a blade groove therebetween, the first blade bar and the second blade bar having side edges abutting the groove, the first blade bar and the second blade bar defining a direction of travel;

wherein the first blade bar and the second blade bar have first ends directed in the second direction toward the feed edge of the refining surface and second ends directed in the first direction toward the discharge edge of the refining surface;

wherein the refining surface further comprises at least one third blade bar having a first end directed in the second direction toward the feed edge of the refining surface, and a second end directed in the first direction toward the discharge edge of the refining surface, and a first side edge and a second side edge and an upper surface therebetween;

wherein the first end of the third blade bar forms a guide surface starting at a first end of said guide surface in the second direction toward the feed edge of the refining surface and rising to a second end in the first direction toward the discharge edge of the refining surface so as to guide the lignocellulose-containing material to the upper surface of the third blade bar;

wherein the third blade bar is at most partly between the first blade bar and the second blade bar such that there is a groove on either side of the third blade bar which is not part of the blade groove defined between the first blade bar and the second blade bar;

wherein said guide surface is arranged in the direction of travel of the first blade bar and the second blade bar, and the guide surface is further arranged:

at least partly between the first blade bar and the second blade bar, or between the first blade bar and an imaginary extension of the second blade bar, or between an imaginary extension of the first blade bar and the second blade bar; or between the imaginary extensions of both the first blade bar and the second blade bar; and wherein the first side edge and the second side edge of the third blade bar are, at the same time, in contact with either:

the side edge of the first blade bar and the side edge of the second blade bar, or the side edge of the first blade bar and an imaginary extension of the side edge of the second blade bar, or an imaginary extension of the side edge of the first blade bar and the side edge of the second blade bar, or the imaginary extensions of the side edges of both the first blade bar and the second blade bar.

12. The blade segment of claim 11 wherein the second end of the first blade bar is spaced from the feed edge of the refining surface of the blade segment a distance substantially equal to a distance the second end of the second blade bar is spaced from the feed edge of the refining surface of the blade segment; and wherein the second end of the guide surface of the third blade bar is spaced a distance from the feed edge of the refining surface of the blade segment that is equal to or greater than the distances the second end of the first blade bar and the second end of the second blade bar are spaced from the feed edge of the refining surface of the blade segment.

13. The blade segment of claim of claim 12 wherein the first end of the guide surface of the third blade bar is spaced a distance of from the feed edge of the refining surface of the blade segment that is equal to or greater than the distances the second ends of the first blade bar and the second blade bar are spaced from the feed edge of the refining surface of the blade segment.

14. The blade segment of claim 12 wherein the distance of the first end of the guide surface of the third blade bar from the feed edge of the refining surface of the blade segment is less than the distances the second end of the first blade bar and the second end of the second blade bar are spaced from the feed edge of the refining surface of the blade segment.

15. The blade segment of claim 11 wherein the second end of the first blade bar is spaced from the feed edge of the refining surface of the blade segment a distance substantially equal to a distance the second end of the second blade bar is spaced from the feed edge of the refining surface of the blade segment; and wherein the second end of the guide surface of the third blade bar is spaced a distance from the feed edge of the refining surface of the blade segment that is less than the distances the second end of the first blade bar and the second end of the second blade bar are spaced from the feed edge of the refining surface of the blade segment.

16. The blade segment of claim 11 wherein the second end of the first blade bar is spaced from the feed edge of the refining surface of the blade segment a distance greater than a distance the second end of the second blade bar is spaced from the feed edge of the refining surface of the blade segment; and wherein the second end of the guide surface of the third blade bar is spaced a distance from the feed edge of the refining surface of the blade segment that is less than or equal to the distance the second end of the first blade bar is spaced from the feed edge, and the distance the second end of the guide surface of the third blade bar is spaced from the feed edge of the refining surface of the blade segment is greater than the distance the second end of the second blade bar is spaced from the feed edge.

17. The blade segment of claim 16, wherein the distance of the first end of the guide surface of the third blade bar from the feed edge of the refining surface of the blade segment is greater than the distance of the second end of the second blade bar from the feed edge of the refining surface of the blade segment.

18. The blade segment of claim 16 wherein the first end of the guide surface of the third blade bar is spaced a distance from the feed edge of the refining surface of the blade segment that is less than or equal to the distance of the second end of the second blade bar from the feed edge of the refining surface of the blade segment.

19. The blade segment of claim 11 wherein the guide surface comprises at least one portion rising in a linear, concave or convex manner.

20. The blade segment of claim 11 wherein the blade groove has portions defining a blade groove bottom; and wherein the guide surface rises in a linear manner from the bottom of the blade groove at an angle of elevation of the guide surface relative to the bottom of the blade groove which is between 20 to 55 degrees.

21. A refiner for defibrating lignocellulose-containing material, wherein the refiner comprises:

a stator;

a rotor, mounted for rotation opposed to the stator;

a refiner surface formed directly on the stator or the rotor, or on at least one blade segment forming the refiner surface, wherein the refining surface has a feed edge for receiving a feed flow of the lignocellulose-containing material to be refined and a discharge edge for discharging a refined lignocellulose-containing material, the discharge edge spaced from the feed edge;

wherein a first direction is defined toward the discharge edge from the feed edge;

wherein a second direction is defined toward the feed edge from the discharge edge;

wherein the refining surface has at least one first blade bar and at least one second blade bar, the first blade bar and the second blade bar defining a blade groove therebetween, the first blade bar and the second blade bar having side edges abutting the groove, the first blade bar and the second blade bar defining a direction of travel;

wherein the first blade bar and the second blade bar have first ends directed in the second direction toward the feed edge and second ends directed in the first direction toward the discharge edge of the refining surface;

wherein the refining surface further comprises at least one third blade bar having a first end directed in the second direction toward the feed edge, and a second end directed in the first direction toward the discharge edge, and a first side edge and a second side edge and an upper surface therebetween;

wherein the first end of the third blade bar forms a guide surface starting at a first end of said guide surface in the second direction toward the feed edge and rising to a second end in the first direction toward the discharge edge so as to guide the lignocellulose-containing material to the upper surface of the third blade bar;

wherein the third blade bar is at most partly between the first blade bar and the second blade bar such that there is a groove on either side of the third blade bar which is not part of the blade groove defined between the first blade bar and the second blade bar;

wherein said guide surface is arranged in the direction of travel of the first blade bar and the second blade bar, and the guide surface is further arranged:

at least partly between the first blade bar and the second blade bar, or between the first blade bar and an imaginary extension of the second blade bar, or between an imaginary extension of the first blade bar and the second blade bar, or between the imaginary extensions of both the first blade bar and the second blade bar; and wherein the first side edge and the second side edge of the third blade bar are, at the same time, in contact with either:

the side edge of the first blade bar and the side edge of the second blade bar, or the side edge of the first blade bar and an imaginary extension of the side edge of the second blade bar, or an imaginary extension of the side edge of the first blade bar and the side edge of the second blade bar, or with the imaginary extensions of the side edges of both the first blade bar and the second blade bar.

* * * * *